US011629707B2

(12) United States Patent
Keijers et al.

(10) Patent No.: US 11,629,707 B2
(45) Date of Patent: Apr. 18, 2023

(54) PUMP SYSTEM FOR HANDLING A SLURRY MEDIUM

(71) Applicant: WEIR MINERALS NETHERLANDS B.V., Venlo (NL)

(72) Inventors: Ronald Godefridus Anna Keijers, Venlo (NL); Rudolfus Johannes Adeleida Van Rijswick, Venlo (NL)

(73) Assignee: WEIR MINERALS NETHERLANDS B.V., Venlo (NL)

( * ) Notice: Subject to any disclaimer, the term of this patent is extended or adjusted under 35 U.S.C. 154(b) by 0 days.

(21) Appl. No.: 16/633,767

(22) PCT Filed: Jul. 11, 2018

(86) PCT No.: PCT/NL2018/050464
§ 371 (c)(1),
(2) Date: Jan. 24, 2020

(87) PCT Pub. No.: WO2019/022593
PCT Pub. Date: Jan. 31, 2019

(65) Prior Publication Data

US 2020/0240399 A1 Jul. 30, 2020

(30) Foreign Application Priority Data

Jul. 27, 2017 (NL) ..... 2019357

(51) Int. Cl.
*F04B 9/117* (2006.01)
*F04B 15/02* (2006.01)

(52) U.S. Cl.
CPC ..... *F04B 9/117* (2013.01); *F04B 15/02* (2013.01)

(58) Field of Classification Search
CPC .... F04B 11/00–0091; F04B 9/08; F04B 9/10; F04B 9/109; F04B 9/1095; F04B 9/117; F04B 9/1176; F04B 9/1178
(Continued)

(56) References Cited

U.S. PATENT DOCUMENTS 3,663,129 A * 5/1972 Antosh ..... F04B 11/005 417/516
3,667,869 A * 6/1972 Karl ..... F01L 25/08 417/346

(Continued)

FOREIGN PATENT DOCUMENTS

DE 10 2005 008 217 A1 8/2006
WO 2013/178373 A1 12/2013

(Continued)

OTHER PUBLICATIONS

International Search Report of related PCTNL2018050464, dated Oct. 2, 2018, 11 pages.

*Primary Examiner* — Thomas Fink
(74) *Attorney, Agent, or Firm* — Casimir Jones, S.C.; Brian F. Bradley

(57) ABSTRACT

This disclosure relates to a pump system for handling a slurry medium, the pump system comprising a pump unit (101) consisting of at least two reciprocating positive displacement slurry pumps, both pumps being arranged for alternating intake of slurry medium via a slurry suction inlet (103) and discharge of slurry medium via a slurry discharge outlet (103); a pump drive unit (104) for driving the at least two reciprocating positive displacement pumps of said pump unit; as well as a slurry damping pump unit (105) for damping discharge pulsations in the slurry medium being pumped.

5 Claims, 3 Drawing Sheets

(58) Field of Classification Search
USPC ..... 417/900, 540
See application file for complete search history.

(56) References Cited

U.S. PATENT DOCUMENTS 3,741,078 A * 6/1973 Johnson ..... F01L 25/08 92/244
3,963,385 A * 6/1976 Caban ..... F04B 7/0034 417/517
5,064,360 A * 11/1991 Blum ..... F04B 11/0016 417/519
5,316,451 A 5/1994 Hore et al.
5,316,453 A * 5/1994 Schwing ..... E04G 21/0454 417/516
5,330,327 A * 7/1994 Anderson ..... F04B 7/0258 417/53
5,993,181 A * 11/1999 Hudelmaier ..... F04B 7/0034 417/519
8,827,657 B1 * 9/2014 Priddy ..... F04B 39/1006 417/53
2006/0124546 A1 * 6/2006 Wobben ..... F04B 9/115 210/637
2006/0153700 A1 * 7/2006 Benckert ..... F04B 15/02 417/338
2006/0193738 A1 * 8/2006 Schwing ..... F04B 15/023 417/523
2009/0044951 A1 * 2/2009 Milkovisch ..... E21B 49/10 166/369
2015/0330374 A1 * 11/2015 Hudelmaier ..... F04B 11/005 137/1
2017/0101986 A1 * 4/2017 Horwath ..... F16L 55/053
2017/0204840 A1 * 7/2017 Keijers ..... F04B 49/106

FOREIGN PATENT DOCUMENTS

WO 2016/144161 A1 9/2016
WO 2019022593 A1 1/2019

* cited by examiner

PUMP SYSTEM FOR HANDLING A SLURRY MEDIUM

BACKGROUND OF THE INVENTION

This disclosure relates to a pump system for handling a slurry medium, the pump system comprising a pump unit consisting of at least two reciprocating positive displacement slurry pumps, both pumps being arranged for alternating intake of slurry medium via a slurry suction inlet and discharge of slurry medium via a slurry discharge outlet; a pump drive unit for driving the at least two reciprocating positive displacement pumps of said pump unit; as well as a slurry damping pump unit for damping discharge pulsations in the slurry medium being pumped.

In reciprocating positive displacement pumps, a displacement element, such as a piston or plunger, undergoes a reciprocating motion inside a cylinder housing enabling the positive displacement the slurry medium to be handled (displaced or pumped). In a particular embodiment of the reciprocating pump, the reciprocating motion of the displacement element is generated by a mechanism which transfers the rotating motion of the pump drive unit mechanism into a reciprocating motion of the displacement element. Particular embodiments of this mechanism may include crankshaft, eccentric shaft, camshaft or cam disc mechanisms, for example as disclosed in FIG. 1 of WO2011/126367.

In another embodiment of the reciprocating pump, the reciprocating motion of the displacement element is generated by the rotating motion of the pump drive unit mechanism driving a hydraulic drive motor, which in turn displaces a hydraulic medium through a hydraulic piping system to and from reciprocating positive displacement pump. Such reciprocating positive displacement pumps are used for pumping slurry media against relatively high pressure, when compared to single stage centrifugal pumps, for example. Further characteristics of such reciprocating positive displacement pumps include more constant and an accurate flow output, but a relatively low flow capacity when compared to centrifugal pumps. When the flow requirements of a typical application cannot be met with a single pump, multiple positive displacement pumps can be arranged in parallel in a manner so that their suction inlets and/or discharge outlets are connected and combined into a single suction and/or discharge line. This means that the sum flow of the individual pumps can meet the total flow requirements of the application. The combination of the individual displacement pumps and the interconnecting suction and discharge lines forms a so-called pumping system.

Due to the individual pump cycles of the individual positive displacement pumps the outlet flow of slurry at the discharge outlet exhibits pulsations, due to a small drop in the outlet flow at the time that one displacement pump switches from its discharge stroke to its suction stroke, whereas the other displacement pump switches from its suction stroke to its discharge stroke and vice versa. A nearly pulsation-free flow in the discharge outlet is obtained with the implementation of a so-called slurry damping pump unit.

Such slurry damping pump unit is connected with the discharge outlet and dampens said discharge pulsations in the slurry medium being pumped by adding a subsequent amount of slurry medium to the outlet flow at the time of said switch over moments of the individual positive displacement pumps.

The operation of the presently known pump systems implementing a slurry damping pump unit based upon expansion of nitrogen, and/or separate hydraulic drives of the individual positive displacement pumps and the pump cycle of the slurry damping unit are inefficient. This results, next to still significant pulsations in the discharge outlet flow, also in continuously changing motor load of the pump drive unit, resulting in power peak loads and power outage. These phenomenon will significantly reduce the life expectancy of the components, in particular that of the pump drive unit and as such the design of drive unit components need to be based upon this fluctuations. In particular the design and sizing of the several components need to be higher to ensure a proper working and lifetime.

SUMMARY OF THE DISCLOSURE

In a first aspect, embodiments are disclosed of a pump system for pumping a slurry medium, the pump system comprising:

a pump unit consisting of at least two reciprocating positive displacement slurry pumps, both pumps being arranged for alternating intake of slurry medium via a slurry suction inlet and discharge of slurry medium via a slurry discharge outlet;

a pump drive unit for driving the at least two reciprocating positive displacement pumps of said pump unit; as well as a slurry damping pump unit for damping discharge pulsations in the slurry medium being pumped, wherein the pump drive unit is arranged in driving alternatively the at least two reciprocating positive displacement pumps and the slurry damping pump unit.

Herewith a simplified construction with a more constant motor load is obtained, limiting power peak loads and power outage and limiting standstill and extending the life expectancy of the components.

The afore mentioned benefit is further guaranteed as in a further aspect of the pump system, the pump drive unit comprises at least one main drive motor as well as at least two hydraulic drive motors, each of said at least two hydraulic drive motors being coupled to an output drive axle of said at least one main drive motor, and wherein each of said at least two hydraulic drive motors is arranged in driving the pump unit and the damping pump unit respectively. This example further simplifies the construction, guarantees a constant motor load of the pump drive unit as well as a constant slurry flow and a constant energy use, thus limiting power peak loads and power outage and standstill.

In a further aspect of the invention the damping pump unit comprises a reciprocating positive displacement damping pump for alternating intake of slurry medium via an inlet interconnected with said slurry discharge outlet. In particular said reciprocating positive displacement damping pump comprises a hydraulic damping piston/cylinder as well as a slurry damping piston/cylinder, the pistons of both hydraulic and slurry damping piston/cylinder being interconnected and said hydraulic damping piston/cylinder being driven by said at least one hydraulic drive motor of said pump drive unit.

More in particular the reciprocating positive displacement damping pump comprises a further hydraulic damping piston/cylinder being driven by said at least one hydraulic drive motor of said pump drive unit as well as a hydraulic damping line interconnecting both cylinders of the hydraulic damping piston/cylinders opposite of their piston side thereof (and in fact at the rod-side).

Herewith a more effective damping of the pulsations in the outlet flow of the slurry medium to be handled is obtained using one main power drive unit for the complete pump system.

In yet another example each reciprocating positive displacement slurry pump comprises a hydraulic piston/cylinder as well as a slurry piston/cylinder, the pistons of both hydraulic and slurry piston/cylinder being interconnected and the hydraulic piston/cylinder being driven by said at least one hydraulic drive motor of said pump drive unit.

More in particular a hydraulic line interconnects the cylinders of the hydraulic piston/cylinders of the at least two reciprocating positive displacement slurry pumps opposite of their piston side thereof (in fact at the rod-side).

This guarantees a proper timing of the individual pump cycles of the individual positive displacement pumps resulting in a nearly pulsation-free flow in the discharge outlet.

In a further example hydraulic release/refill means are present for releasing/adding hydraulic medium from/to the hydraulic line. This allows for correcting the end positions of the pistons in their respective cylinders due to leakage of hydraulic medium and as such allows for maintaining the proper timing of the individual pump cycles of the individual positive displacement pumps.

BRIEF DESCRIPTION OF THE DRAWINGS

The accompanying drawings facilitate an understanding of the various embodiments.

DETAILED DESCRIPTION

Figure 1:
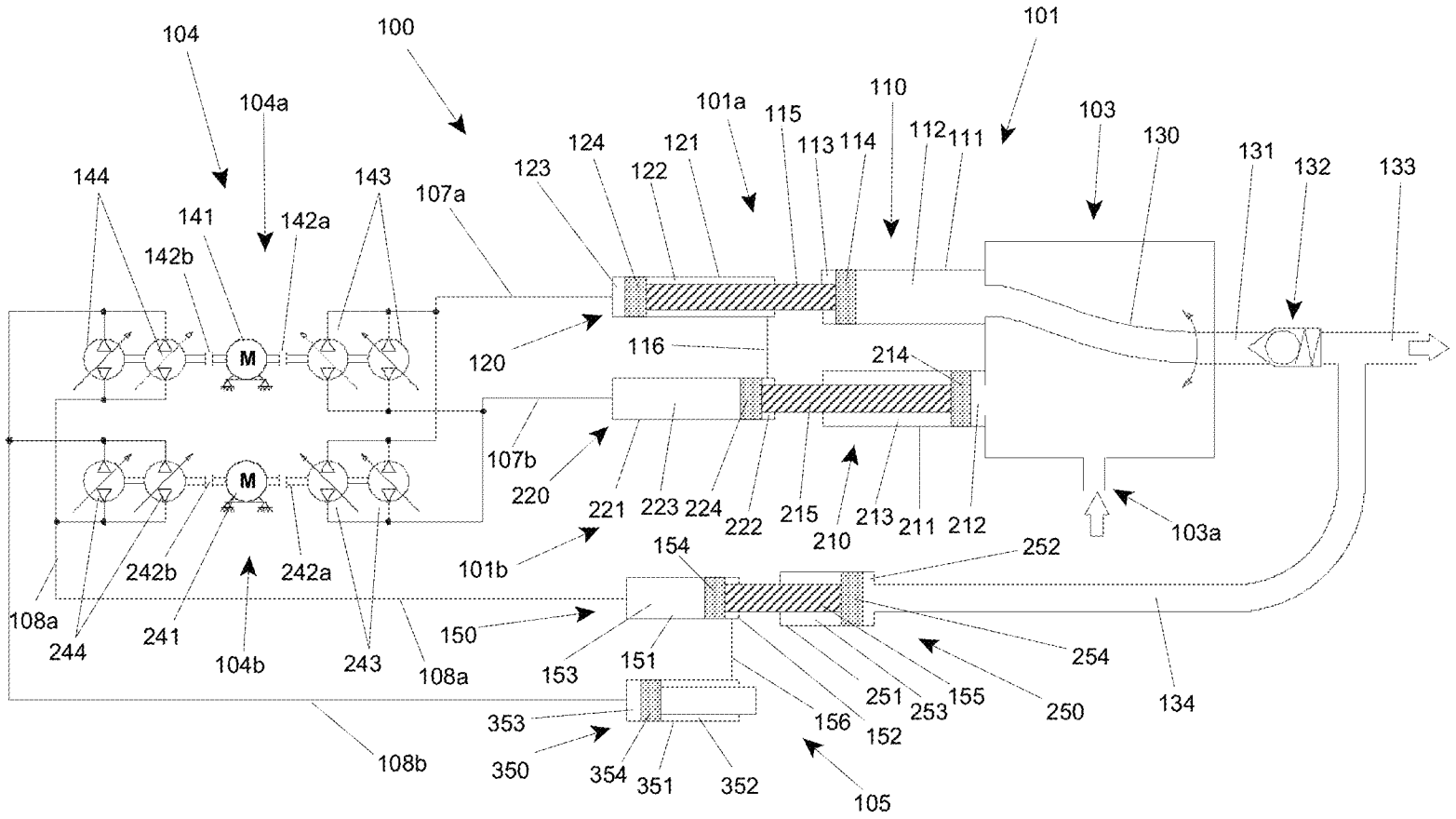
FIG. 1 is a view of an embodiment of a pump system in accordance with the present disclosure.

FIG. 1 discloses a non-limitative embodiment of a pump system for handling a slurry medium. The hydraulic pump system is denoted with reference numeral 100 and consists of a pump unit 101, a slurry suction/discharge unit 103, a pump drive unit 104 and a slurry damping pump unit 105. The pump unit 101 has a configuration, meaning that is comprises at least two (a first and a second) reciprocating positive displacement pumps 101*a* and 101*b*, which are incorporated in a pump housing (not depicted) and connected to the slurry suction/discharge unit 103.

Each of the first and second reciprocating positive displacement pumps 101*a* (101*b*) consist of a pump structure or slurry suction/discharge piston-cylinder 110 (210) in which a displacement element 114 (214), shaped as a piston, is movable accommodated in a cylinder housing 111 (21). The displacement element or piston 114 (214) is connected via a piston rod 115 (215), which is displaced in a reciprocating manner using a pump drive mechanism configured as a hydraulic piston-cylinder 120 (220).

Each hydraulic piston-cylinder 120 (220) of the first/second reciprocating positive displacement pumps 101*a* (101*b*) consists of a cylinder housing 121 (221) in which a displacement element or piston 124 (224) is movable accommodated. Piston 124 (224) of each hydraulic piston-cylinder 120 (220) is connected with said previously mentioned piston rod 115 (215) and the piston 114 (214) of the slurry suction/discharge piston-cylinder 110 (210) of the first/second reciprocating positive displacement pumps 101*a* (101*b*).

Such a reciprocating positive displacement pump 101*a* (101*b*) is capable of pumping or handling a slurry medium against relatively high pressure when compared to other types of pumps, such as centrifugal pumps. In particular, a positive displacement pump (as denoted with reference numeral 101*a* and 101*b* in FIG. 1) can operate at a high pressure level and generate an accurate flow output of the slurry medium to be displaced, albeit with a relatively low flow capacity. For increasing the flow capacity of the slurry medium to be displaced, multiple reciprocating positive displacement pumps (in FIG. 1 two of such pumps 101*a*, 101*b* are shown) are used in a parallel manner as depicted in FIG. 1 and their combined pump characteristic is used for obtaining the required and necessary increased discharge flow of the slurry medium.

The pump drive mechanism consisting of the pump drive unit 104 and the first/second hydraulic piston-cylinders 120 and 220 are driven in such a manner that the displacement elements 114 (214) are moving in a reciprocating manner, but also in an 'out-of-phase' manner. This means that one positive displacement pump performs its discharge stroke, whereas the other positive displacement pump performs its suction stroke. The alternating suction and discharge strokes of the two positive displacement pumps results in a combined discharge flow of the individual pumps, the sum of which can meet the total flow requirements of the industrial application in which the pump system is to be implemented.

The displacement element or piston 114 (214) of the first/second slurry discharge piston-cylinder 110 (210) divides the cylinder housing 111 (211) in a first cylinder chamber 112 (212) and a second cylinder chamber 113 (213). The first cylinder chamber 112 (212) serves for the reciprocating intake (or suction) and discharge of a slurry medium from a slurry inlet 103*a* of the slurry suction/discharge unit 103 via a switching outlet 130, which connects via a slurry outlet 131 to a main slurry outlet piping 133. To avoid a back flow or re-entering of slurry medium already discharged into the main slurry outlet piping 133 back into the slurry suction/discharge unit 103 due to the static pressure in the main slurry outlet piping 133 a one-way valve 132 is accommodated in the slurry outlet 131.

Similarly, the displacement element or piston 124 (224) of the first/second hydraulic piston-cylinders 120 (220) divides the respective cylinder housing 121 (221) in a first cylinder chamber 122 (222) and a second cylinder chamber 123 (223). As clearly shown in FIG. 1, both first cylinder chambers 122 (222) of both first/second hydraulic piston-cylinders 120 (220), opposite of their piston side 124 (224) thereof, are interconnected via a hydraulic line 116. Each second cylinder chamber 123 (223) of both first/second hydraulic piston-cylinders 120 (220) is coupled with the pump drive unit 104 by means of a first/second hydraulic supply line 107*a* (107*b*).

Both the first cylinder chamber 122 (222) and the second cylinder chamber 123 (223) of the first/second reciprocating positive displacement slurry pumps 101*a* (101*b*) are filled with a hydraulic medium, such as an oil, which is pumped through the hydraulic piping of the multistage pump system.

During the discharge stroke of the first reciprocating positive displacement slurry pump 101*a*, the pump drive unit 104 will pump a hydraulic medium under pressure via the first hydraulic supply line 107*a* into the second cylinder chamber 123 of the first hydraulic piston-cylinder 120, thereby displacing the piston 124 in the cylinder housing 121. Due to the interconnection of both pistons 124 and 114 by means of the piston rod 115, piston 114 of the slurry piston-cylinder 110 will be displaced within the cylinder housing 111 and will discharge slurry medium accumulated in the first cylinder chamber 112 of the slurry piston-cylinder 110 via the switching outlet 130, the slurry outlet 101 through the now open one-way valve 132 towards the main slurry outlet piping 134.

Hydraulic medium, present in the first cylinder chamber 122 of the first hydraulic piston-cylinder 120, will be displaced via the hydraulic interconnecting line 116 towards the first chamber 222 of the hydraulic piston-cylinder 220 of the second reciprocating positive displacement slurry pump 101*b*, pushing the piston 224 and likewise the piston 214 of the slurry piston-cylinder 210 in the opposite direction, thereby performing a suction stroke for the intake of slurry medium via the slurry inlet 103*a* of the slurry suction/discharge unit 103 into the first cylinder chamber 212 of the slurry piston-cylinder 210 of the second reciprocating positive displacement slurry pump 101*b*. Hydraulic medium accumulated in the second cylinder chamber 223 of the second hydraulic piston-cylinder 220 will be returned towards the hydraulic medium piping of the pump drive unit 104 via the second hydraulic supply line 107*b*.

Once the discharge stroke of the first reciprocating positive displacement slurry pump 101*a* has been fulfilled, meaning that the piston 114 of the first slurry piston-cylinder 110 has emptied the slurry contained in the first cylinder chamber 112 towards the main slurry outlet piping 133, the switching outlet 130 is switched towards the first cylinder chamber 212 of the second slurry piston-cylinder 210 of the second reciprocating positive displacement slurry pump 101*b*, which first cylinder chamber 212 is now filled with slurry medium, which has been taken in during its suction stroke via the slurry inlet 103*a* of the slurry suction/discharge unit 103.

The subsequent pumping of hydraulic medium under pressure via the second hydraulic supply line 107*b* towards the second cylinder chamber 223 of the second hydraulic piston-cylinder 220 of the second reciprocating positive displacement slurry pump 101*b* by the pump drive unit 104 results in performing its discharge stroke thereby discharging slurry in the first cylinder chamber 212 via the switching outlet 130 towards the main slurry outlet piping 133. Similarly, the first cylinder chamber 222 of the second hydraulic piston-cylinder 220 will empty the hydraulic medium contained therein via the interconnected hydraulic line 116 towards the first cylinder chamber 122 of the first hydraulic piston-cylinder 120 of the first reciprocating positive displacement slurry pump 101*a*, thereby performing the latter pump 101*a* its suction stroke.

Reference numeral 105 denotes a slurry damping pump unit consisting of a reciprocating positive displacement damping pump 150 (250), exhibiting more or less a similar construction as the reciprocating positive displacement slurry pumps 101*a* and 101*b*. The damping pump unit 105 comprises a hydraulic damping piston-cylinder 150 as well as a slurry damping piston-cylinder 250, the pistons 154 (254) of both piston-cylinders 150 (250) being interconnected via a piston rod 155. Both pistons 154 respectively 254 divide their respective cylinder housings 151 (251) in a first cylinder chamber 152 (252) and a second cylinder chamber 153 (253). The first cylinder chamber 252 of the slurry damping piston-cylinder 250 connects via a damping slurry piping 134 with the main slurry outlet piping 133.

The damping pump unit 105 furthermore comprises a further hydraulic damping piston-cylinder 350, consisting of a cylinder housing 351 which is divided in a first cylinder chamber 252 and a second cylinder chamber 353 by means of a piston 354, which is movable accommodated within the cylinder housing 351. The first cylinder chamber 352 of the further hydraulic damping piston-cylinder 350 is connected with the first cylinder chamber 152 of the hydraulic damping piston-cylinder 150 by means of a hydraulic interconnecting line 156. Both the second cylinder chambers 153 (353) of the hydraulic damping piston-cylinder 150 and the further hydraulic damping piston-cylinder 350 are connected with the pump drive unit 104, using suitable hydraulic supply lines 108*a* (108*b*).

The damping pump unit 105 serves to damp any flow pulsations occurring in the main slurry outlet 133 due to the pulsations in the slurry outlet flow, which are created due to the individual pump cycles of the individual reciprocating positive displacement slurry pumps 101*a* and 101*b*. Such pulsations occur as a result of the dip in the outlet flow at the time that one displacement pump 101*a* switches from its suction stroke to its discharge stroke and vice versa.

To this end, the piston 254 of the slurry damping pump unit 105 is displaced within the cylinder housing 151 performing a suction stroke wherein slurry medium already contained in the main slurry outlet piping 133 and the damping slurry piping 134 is taken in the first cylinder chamber 252.

According to the invention, the pump drive unit 104 is arranged in driving both reciprocating positive displacement slurry pumps 101*a* and 101*b* as well as the damping pump unit 105.

The pump drive unit 104 is in this example configured as a multi-pump drive unit comprising two main drive motors 141 (241), which each drive a pump side motor drive axis 142*a* (242*a*) as well as a damping side motor drive axis 142*b* (242*b*). Each motor drive output axis 142*a* (142*b*) drives one or more hydraulic pumps 143-144 (243-244), the hydraulic pumps 143 (243) coupled to the pump side motor drive axis 142*a* (242*a*) serve to pump the hydraulic medium under pressure through the first and second hydraulic supply lines 107*a* (107*b*) from and to the second hydraulic cylinder chambers 123 (223) of the hydraulic piston-cylinders 120 (220) of the first and second reciprocating positive displacement slurry pumps 101*a* (101*b*).

Likewise, the hydraulic motors 144 (244) coupled to the damping side motor drive output axis 142*b* (242*b*) serve to pump a hydraulic medium under pressure via the hydraulic supply lines 108 (108*b*) to and from the second cylinder chambers 153 (353) of the hydraulic piston-cylinder 150 and the further hydraulic piston-cylinder 350 of the damping pump unit 105. In a similar fashion as outlined in connection with the hydraulic interconnecting line 116, also in the damping pump unit 105, both first cylinder chambers 152 (352) of the two hydraulic piston-cylinders 150 (350) are interconnected with each other opposite from their piston side 154 (354) via a hydraulic interconnecting line 156.

This allows, during the cyclic suction and discharge strokes of the piston 254 of the damping pump unit 105, to displace hydraulic medium contained in the first cylinder chamber 152 of the first hydraulic piston-cylinder 150 towards the first cylinder chamber 352 of the further hydraulic piston-cylinder 350 and vice versa. The suction stroke of the damping pump unit 105 is performed by transferring hydraulic medium under pressure via the hydraulic supply line 108*b* into the second cylinder chamber 353 of the further hydraulic piston-cylinder 350, thereby displacing the piston 354 in the cylinder housing 351.

Hydraulic medium contained in the first cylinder chamber 352 will be displaced via the interconnecting hydraulic line 156 towards the first cylinder chamber 152 of the hydraulic piston-cylinder 150, thereby displacing the piston 154 within the cylinder chamber 151 towards the left (as seen in FIG. 1). Similarly, the piston 254 being, connected with the piston 154 using the piston rod 150, will be displaced in the same direction (towards the left) and the first cylinder chamber 252 of the slurry piston-cylinder 250 of the damping pump unit 105 will be filled with slurry medium being withdrawn from the main slurry outlet piping 133 and the damping slurry piping 134.

During the switchover of both reciprocating positive displacement slurry pumps 101*a* (101*b*) from their respective discharge stroke towards the suction stroke, the small drop occurrence in the outlet slurry flow in the main slurry outlet piping 133 is compensated by the damping pump unit 105 by performing a discharge stroke, thereby emptying the first cylinder chamber 252 of the slurry piston-cylinder 250, resulting in an extra discharge of slurry medium contained in the first cylinder chamber 252 via the damping slurry piping 134 towards the main slurry outlet piping 133. As a result, a nearly pulsation-free slurry flow in the main slurry outlet piping 133 is obtained.

Additionally, in order to ensure that no flow loss occurs due to the need to compress the slurry in cylinder chamber 112 (212) at the time that the displacement element or piston 114 (214) of the first/second piston-cylinder 110 (210) initiates it's discharge stroke, as a follow up of discharge stroke being performed by the displacement element or piston 254 of the damping pump unit 105, a pre-compression stroke is performed prior to starting the actual discharge stroke of the displacement element or piston 114 (214) of the first/second piston-cylinder 110 (210). This means that once the displacement element or piston 254 of the damping pump unit 105 has performed it's discharge stroke and subsequently the displacement element or piston 114 (214) of the first/second piston-cylinder 110 (210) is to perform it's discharge stroke as a follow up, the pressure in the cylinder chamber 113 (213) is pre-compressed to the same pressure as in the main slurry outlet piping 133. This pre-compression realizes a nearly pulsation free flow in the main slurry outlet piping 133.

Figure 2:
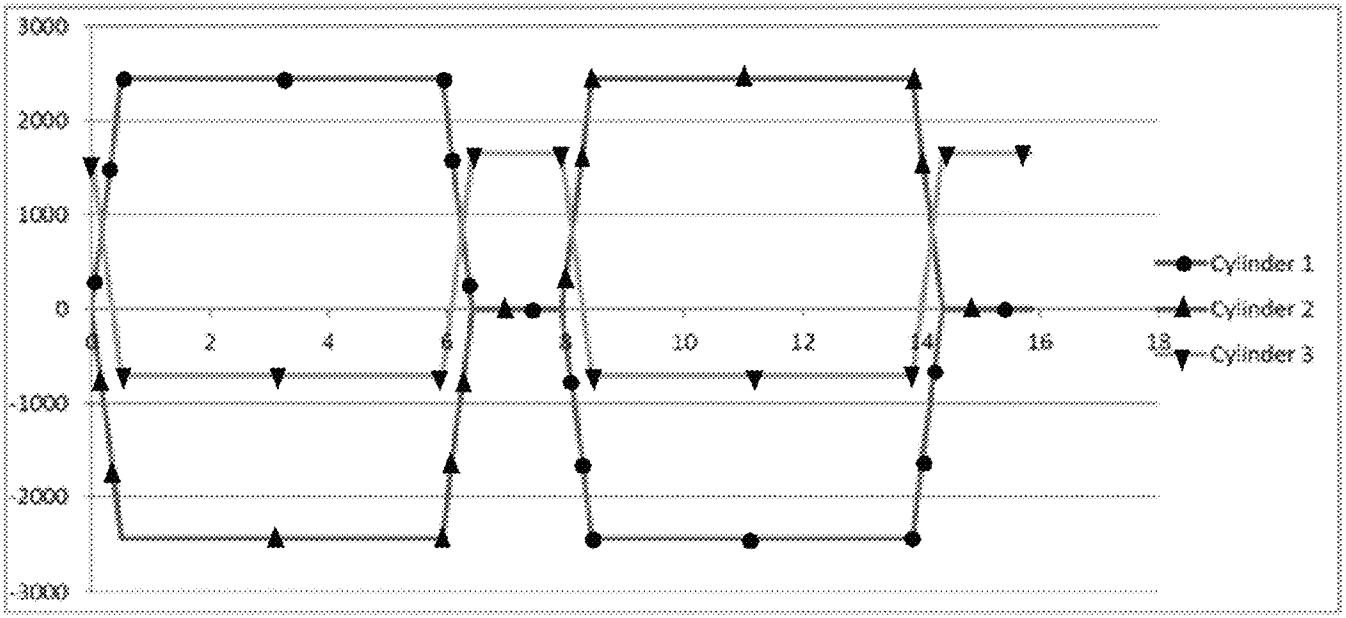
FIG. 2 a pump characteristic of an embodiment of a pump system in accordance with the present disclosure.

FIG. 2 depicts the pump characteristic of the multi-pump system as depicted in FIG. 1, showing the cyclic operation of both main reciprocating positive displacement slurry pump 101*a* (101*b*), which are denoted in FIG. 2 with the annotation cylinder 1 and cylinder 2. As it is observed in the pump characteristic of FIG. 2, each switchover timing wherein the first reciprocating positive displacement slurry pump 101*a* (cylinder 1) switches from its discharge stroke towards its suction stroke and the second reciprocating positive displacement slurry pump 101*b* (cylinder 2 in FIG. 2) switches from its suction stroke towards its discharge stroke, results in a drop in the output flow in the main slurry outlet piping 133. Said drop in the slurry output flow is depicted in FIG. 2, around the timing between 6 and 8. During that switchover timing moment, the damping pump unit 105 (denoted with cylinder 3 in FIG. 2) will perform its discharge stroke, discharging a smaller amount of slurry medium contained in the first cylinder chamber 252 via the damping slurry piping 134 towards the main slurry outlet piping 133. The additional discharge of slurry medium into the main slurry outlet piping 133 by the damping pump unit 105 significantly dampens the pulsations caused by the cyclic switchover timings of the two main reciprocating positive displacement slurry pump 101*a* (101*b*).

The pump drive unit 104 driving both main reciprocating positive displacement slurry pumps 101*a* (101*b*) of the multistage pump unit 101 as well as the damping pump unit 105 allows for a simplified construction as an additional drive unit for the damping pump unit 105 can be obviated. Furthermore, the pump drive unit 104 and in particular the first and second stage motor drives 141 (241) can be driven with a more constant motor load, which will limit power peak loads and power outages. As the motor drives 141 (241) can be driven with a more constant motor load, standstill is significantly reduced and the life expectancy of the components of the pump drive unit 104 is extended.

Due to small oil leakage over the hydraulic pistons it is possible, that after a period of time after the first calibration of the positions of the pistons 114-124 and 214-224, these positions are not correct anymore. In particular during the discharge stroke of the first positive displacement pump 101*a* (equals the suction stroke of the second positive displacement pump 101*b*), hydraulic medium (oil) introduced in the second cylinder chamber 123 of the hydraulic piston-cylinder of first positive displacement pump 101*a* may leak over the piston 124 into the first cylinder chamber 121 at the rod side thereof.

Figure 3:
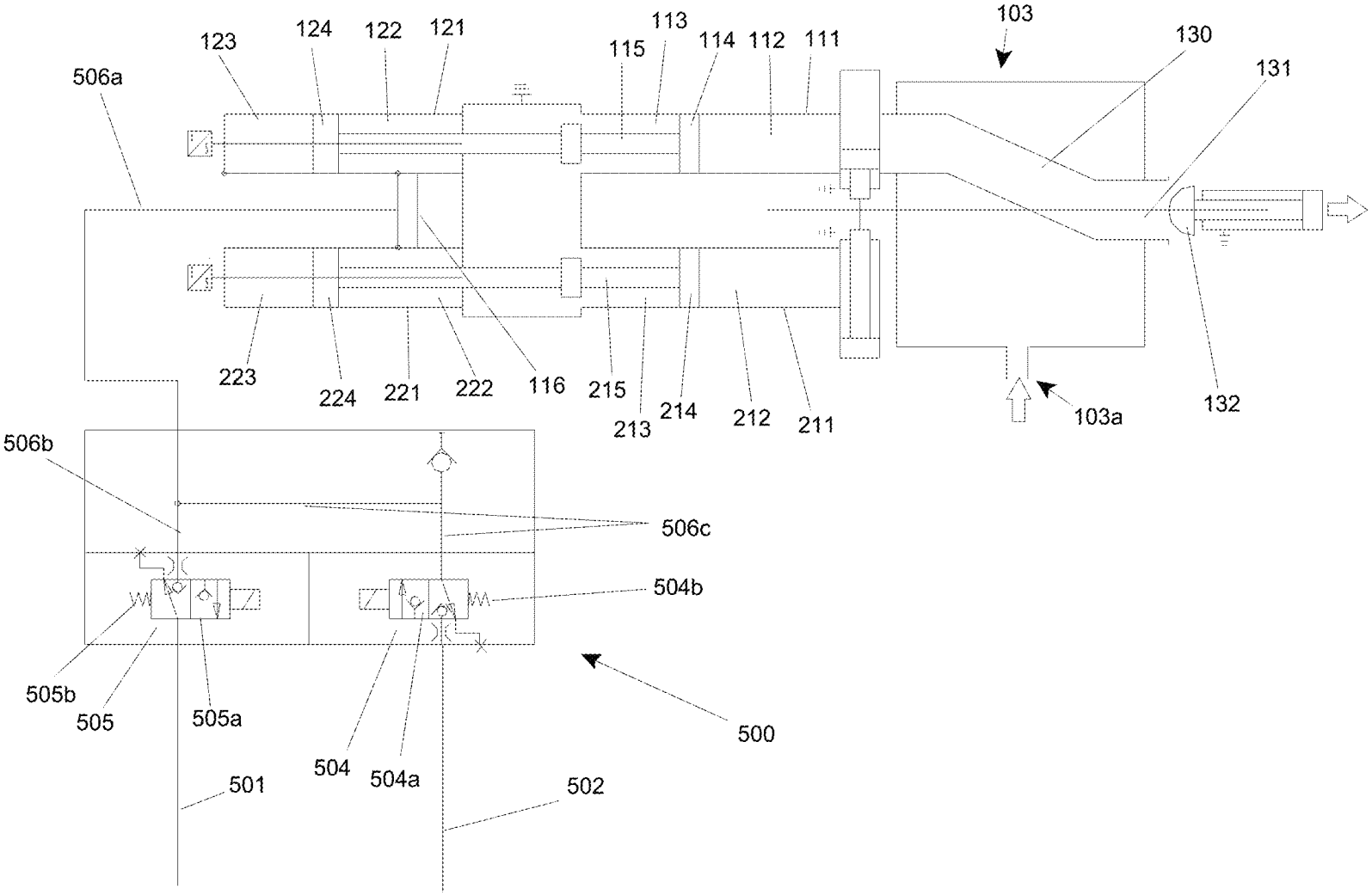
FIG. 3 a detail of the embodiment of FIG. 1.

The result will be that the piston 224 of the hydraulic piston-cylinder of second positive displacement pump 101*b* will reach its end position before the piston 124 does. To prevent this, hydraulic medium has to be released from the rod side (in fact from the first cylinder chamber 122 of the hydraulic piston-cylinder of first positive displacement pump 101*a*). For this, hydraulic release/refill means 500 are implemented as shown in FIG. 3.

Hydraulic release/refill means 500 comprise an outlet valve 505, which—as depicted in FIG. 2—is closed. Upon activation, the spring biased valve body 505*a* is displaced against the bias force of the spring 505*b* thus interconnecting hydraulic lines 506*a*-506*b* with hydraulic discharge line 501, allowing a surplus of hydraulic medium (oil) collected in the first cylinder chamber 122 of the hydraulic piston-cylinder of first positive displacement pump 101*a* to be released towards an oil pan (not shown).

In another situation, it could occur, that during the discharge stroke of the first positive displacement pump 101*a* (equals the suction stroke of the second positive displacement pump 101*b*), hydraulic medium (oil) leaks from the first cylinder chamber 222 of the hydraulic piston-cylinder of second positive displacement pump 101*b* towards the second cylinder chamber 223. In such situation, the piston 124 will reach its end position before the piston 224 does. To prevent this, hydraulic medium (oil) has to be added to the first cylinder chamber 222 of the hydraulic piston-cylinder of second positive displacement pump 101*b*, allowing the piston 224 in reaching its end position in the cylinder housing 221.

For this, filling valve 504 will be activated, by displacing valve body 504*a* against the bias force of spring 504*b*, allowing an amount of hydraulic medium (oil) to be taken from the oil pan (not shown) via hydraulic line 502, via the interconnected hydraulic line 506*c* and hydraulic line 506*a* and introduced in the first cylinder chamber 222 of the hydraulic piston-cylinder of second positive displacement pump 101*b*.

Similar operational situations will apply when the second positive displacement pump 101*b* is performing its discharging strokes.

LISTING OF REFERENCE NUMERALS

100 multistage pump system
101 pump unit
101*a*/101*b* first/second positive displacement pump
103 slurry discharge unit

104 pump drive unit
105 slurry damping pump unit
104*a*/104*b* first/second pump drive stage
107*a*/107*b* first/second hydraulic supply line for hydraulic piston-cylinder pump of first/second positive displacement pump
108*a*/108*b* hydraulic supply line for slurry/hydraulic piston-cylinder pump of damping unit
110/210 slurry discharge piston-cylinder of first/second positive displacement pump
111/211 cylinder housing
112/212 first cylinder chamber
113/213 second cylinder chamber
114/214 piston
115/225 coupling axis
116 interconnecting hydraulic line between hydraulic piston-cylinder 120/220
130 switching outlet
131 slurry outlet
132 one-way valve
133 main slurry outlet piping
134 damping slurry piping
120/220 hydraulic piston-cylinder of first/second positive displacement pump
121/221 cylinder housing
122/222 first cylinder chamber
123/223 second cylinder chamber
124/224 piston
141/241 first/second stage motor drive
142*a*/242*a* pump side motor drive axes
142*b*/242*b* damping side motor drive axes
143/243 first/second hydraulic motor at the slurry pump side
144/244 hydraulic motor at the damping pump side
150/250 hydraulic/slurry piston-cylinder of damping pump unit
151/251 cylinder housing
152/252 first cylinder chamber
153/253 second cylinder chamber
154/254 piston
155 coupling axis
156 interconnecting hydraulic line between hydraulic piston-cylinder 150/350
350 hydraulic return piston-cylinder
351 cylinder housing
352 first cylinder chamber
353 second cylinder chamber
354 piston
500 hydraulic release/refill means
501 hydraulic discharge line
502 hydraulic filling line
504 filling valve
504*a* valve body
504*b* valve spring
505 outlet valve
505*a* valve body
505*b* valve spring
506*a* hydraulic line
506*b* hydraulic line
506*c* hydraulic line

The invention claimed is:

1. A pump system for pumping a slurry medium, the pump system comprising:

a first positive displacement pump and a second positive displacement pump reciprocating out of phase with the first positive displacement pump;

a slurry suction/discharge unit including a discharge outlet and a one-way valve positioned in the discharge outlet;

a main outlet fluidly coupled to the discharge outlet;

a damping unit including a damping pump fluidly coupled to the main outlet;

a drive unit for driving the first positive displacement pump, the second positive displacement pump, and the damping pump;

wherein the drive unit comprises a drive motor, a first hydraulic pump driven by the drive motor, and a second hydraulic pump driven by the drive motor; the first hydraulic pump is fluidly coupled to the first positive displacement pump and the second positive displacement pump; and the second hydraulic pump is fluidly coupled to the damping unit;

wherein the damping pump includes a first hydraulic piston positioned within a first hydraulic cylinder, and a slurry piston connected with the first hydraulic piston;

wherein the damping pump includes a second hydraulic piston positioned within a second hydraulic cylinder;

wherein the second hydraulic piston is driven by the second hydraulic pump; and wherein the damping pump includes a hydraulic damping line interconnecting the first hydraulic cylinder and the second hydraulic cylinder.

2. The pump system according to claim 1, wherein the first hydraulic cylinder includes a first end and a second end, the first end of the first hydraulic cylinder is fluidly coupled to the second hydraulic pump; and wherein the second hydraulic cylinder includes a first end and a second end, the first end of the second hydraulic cylinder is fluidly coupled to the second hydraulic pump, and wherein the hydraulic damping line interconnects the second end of the first hydraulic cylinder and the second end of the second hydraulic cylinder.

3. The pump system according to claim 1, wherein the first positive displacement pump includes a first hydraulic piston connected with a first slurry piston and wherein the second positive displacement pump includes a second hydraulic piston connected with a second slurry piston.

4. The pump system according to claim 3, wherein the first hydraulic piston is positioned with a first hydraulic cylinder with a first end and a second end, and the second hydraulic piston is positioned within a second hydraulic cylinder with a first end a second end, wherein the first end of the first hydraulic cylinder and the first end of the second hydraulic cylinder are fluidly coupled to the first hydraulic pump; and wherein a hydraulic line interconnects the second end of the first hydraulic cylinder and the second end of the second hydraulic cylinder.

5. The pump system according to claim 4, further comprising hydraulic release/refill means for releasing or filling hydraulic medium to the system.

* * * * *